United States Patent [19]

Kavesh

[11] 3,938,583

[45] Feb. 17, 1976

[54] APPARATUS FOR PRODUCTION OF CONTINUOUS METAL FILAMENTS

[75] Inventor: Sheldon Kavesh, Whippany, N.J.

[73] Assignee: Allied Chemical Corporation, New York, N.Y.

[22] Filed: Oct. 17, 1974

[21] Appl. No.: 515,740

Related U.S. Application Data

[62] Division of Ser. No. 348,814, April 6, 1973, Pat. No. 3,856,074.

[52] U.S. Cl. ..... 164/276

[51] Int. Cl.[2] ..... B22D 11/06

[58] Field of Search ..... 164/87, 276; 264/165; 425/223, 224

[56] References Cited

UNITED STATES PATENTS

| | | | |
|---|---|---|---|
| 2,074,812 | 3/1937 | Sendzimir | 164/87 |
| 3,862,658 | 1/1975 | Bedell | 164/87 |
| 3,881,540 | 5/1975 | Kavesh | 164/87 |

*Primary Examiner*—Ronald J. Shore
*Attorney, Agent, or Firm*—Arthur J. Plantamura; David W. Collins

[57] ABSTRACT

A method for producing and concomitantly winding continuous metal filament in which a quenching wheel is used as a quenching element and in which sufficient pressure is exerted on the filament just beyond the point of solidification to counteract the tensional stress exhibited by the winder on the filament.

4 Claims, 3 Drawing Figures

APPARATUS FOR PRODUCTION OF CONTINUOUS METAL FILAMENTS

This is a division of application Ser. No. 348,814, filed Apr. 6, 1973, now U.S. Pat. No. 3,856,974.

BACKGROUND OF THE INVENTION

The present invention relates to an improvement in the production of continuous metal filaments of indefinite length which are normally wound on spools. More specifically, for the purposes of the invention, filament is herein used to represent a slender body whose transverse dimensions are much less than its length. In the present context, the filaments may be ribbons, sheets, wires or irregular cross-sections.

During recent years, researchers developed various methods directed to the formation of metal filaments which avoid the inherent difficulties of previous casting and rolling techniques. These methods include, for example, melt extraction and chill block spinning.

Melt extraction connotes a process wherein a cold quenching wheel rotates at high velocity in "kissing", i.e. skimming, contact with a liquid metal surface. The molten metal wetting the wheel is carried up out of the molten bath, where it solidifies and thereby shrinks away from the wheel and is flung off by centrifugal action. The melt extraction techniques discussed herein are to be distinguished from other extraction methods such as those described in U.S. Pat. No. 1,025,848 to Wagner and U.S. Pat. No. 2,074,812 to Sendzimer, which primarily employ a casting technique in which the cold wheel is substantially immersed in the liquid metal and in which the rotational velocity of the wheel is appreciably lower than in the melt extraction.

Chill block spinning is exemplified by U.S. Pat. No. 905,758 to Strange and Pim, U.S. Pat. No. 2,825,108 to Pond, U.S. Pat. No. 2,886,866 to Wade, and U.S. Pat. No. 2,899,728 to Gibbons. In this process, a free jet of molten material is impinged upon a moving chilled quenching surface, preferably a rotating wheel. The molten jet is solidified in the form of a ribbon or sheet and is flung away from the rotating chill surface by centrifugal action.

One important disadvantage in the melt extraction and chill block spinning processes as presently employed is that they produce long, but not genuinely continuous filaments. The flinging action which removes the filament from the wheel induces an oscillating or whipping motion in the filament which inevitably causes breakage. Presently filaments are produced with a maximum length of only about 300 meters. Continuous metal filaments in the range of 1,000 to greater than 30,000 meters in length are required for such applications as strapping, springs, filament-wound vessels, aerospace skins and the like.

An additional problem encountered in the melt extraction and chill block spinning process is that of winding the lengths of filament formed. The incorporation of a tension regulated winder or similar collecting device into the system results in a great amount of stress being transmitted back to the solidification zone, a factor which contributes to the breakage of the filaments. Since the "down time" caused by rethreading the filaments onto the winder after breakage is considerable, the metal filaments must be wound in a separate operation. There is obviously a need for a method to produce continuous lengths of metal filaments which can be wound concomitantly with production.

SUMMARY OF THE INVENTION

It is therefore an object of this invention to produce continuous metal filament, or ribbon or sheet.

It is another object to produce a continuous filament or sheet which can be automatically collected in a neat coiled package concomitantly with its production.

These and other objects and advantages will become apparent from the description and examples provided herein.

Accordingly, this invention is directed to an improvement in the production of metal filaments, ribbons or sheets. In the production of these materials using a rotating wheel as the quenching source, the improvement comprises establishing a tension-free zone by positioning a pressure exerting means in nipping contact with the quenching source beyond the point of solidification; ideally, just at the point where shrinkage of the filament causes detachment from the quenching source. In an additional aspect of the invention, the filament can then be directed from the nipping means and wound on a tension controlled winder or other collecting means such as a spinning bucket. Thus, the nipping action isolates the fragile filament or sheet in the solidification zone from the tension exerted by the winder. The continuous tension exerted by the winder and/or tension regulating mechanism used in conjunction with the winder prevents whipping, thereby avoiding filament breakage and enabling production of a truly continuous filament.

The nipping means employed may be any device having freedom of movement and capable of exerting sufficient pressure on the solidifying filament to counteract the stress transmitted by the winder and also by inherent centrifugal and gravitational forces thereby preventing breakage. The device may be in the form of a bar, a blunt blade or preferably, a cold wheel freely rotating or driven at the same surface velocity as the quench wheel. In this regard, it is to be noted that the role of the nipping device is not merely that of a "guide". It is intrinsic to this invention that pressure be exerted by the device onto the solidifying filament and not merely that the filament be guided around the device. The mere positioning of a guide wheel at the point of solidification does not prevent breakage of the filament since it does not counteract the centrifugal or gravitational forces or the tensional stress transmitted by the winder. The arrangement of the invention requires, as an essential facet, freedom of movement so that the nipping device can readily adapt to use in forming filaments of various thickness and does not have to be individually adjusted.

The amount of pressure which the device exerts upon the filament depends upon the magnitude of the winding tension and the coefficients of friction between the filament and the quench roller and between the filament and nip roller. The relationship between those quantities is expressed by the following inequality:

$$P \geq \frac{T}{\mu \, QR + \mu_{SR}} \qquad \text{Equation (1)}$$

wherein $P$ is the applied nipping pressure represented in lbs/inch of filament width. $T$ is the winding tension in lbs/inch of filament width. $\mu QR$ and $\mu NR$ are the coefficients of friction between the filament and the quench roller and the filament and the nip roller respectively.

This novel method for producing continuous wound filaments could be easily adapted to any process for preparing filaments in which the quenching step is carried out on a chill wheel, drum, etc. and the filament is separated after solidification by centrifugal force.

This method is particularly useful in very high speed forming operations where formation and subsequent winding occurs very rapidly and a great amount of stress is transmitted to the solidifying filament.

While this application is directed to the use of the nipping pressure means in conjunction with the use of a tension regulating winder, it is obvious that the invention also includes the production of long or continuous filaments which are not wound concomitantly with their production but are collected in another manner.

DESCRIPTION OF THE PREFERRED EMBODIMENTS

Figure 1:
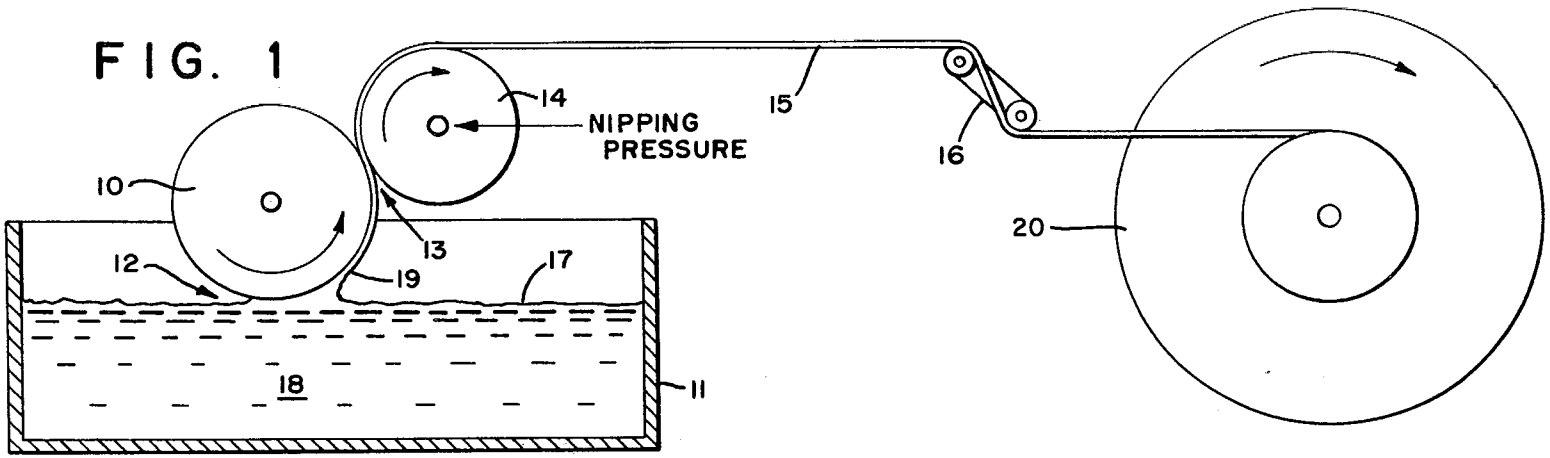
FIG. 1 illustrates diagrammatically an apparatus which uses a wheel melt extraction in conjunction with a nipping wheel in accordance with the invention to produce continuous filaments.
Figure 2:
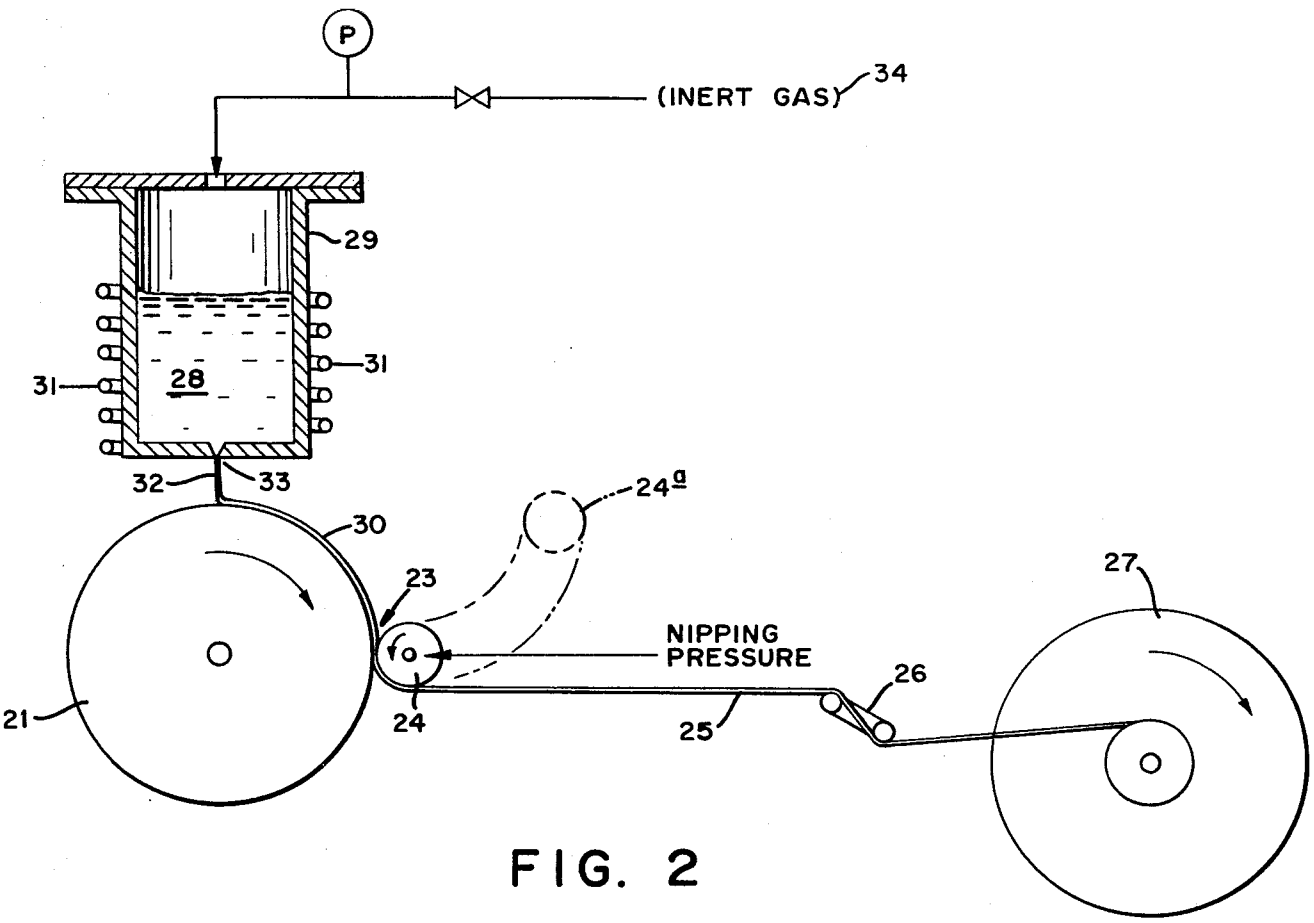
FIG. 2 represents a modified apparatus in accordance with the invention in which a molten jet is extruded onto a chill wheel before being acted upon by the nipping roll.

FIGS. 1 and 2 are representative of the novel aspects of the present invention. In FIG. 1, a cold wheel 10 rotates in "kissing" contact as shown at 12 with surface 17 of a liquid metal 18 confined in a suitable reservoir 11. The molten metal solidifies on the surface 19 of the wheel 10 and is carried up out of the reservoir 11, and at a point 13 at which it begins to shrink away from the wheel 10 it comes into contact with a second cold wheel 14 which exerts a nipping pressure (between wheels 10 and 14) on the filament 15. The filament 15 is then continuously drawn by a conventional tension control device 16 and wound onto a roller 20. The position of the nipping roller 14 and the pressure which it exerts on the filament 15 are controlled by means of a pressure exerting mechanism such as an air cylinder operating through a conventional connecting link between the roller 14 and the cylinder (not shown).

Figure 1A:
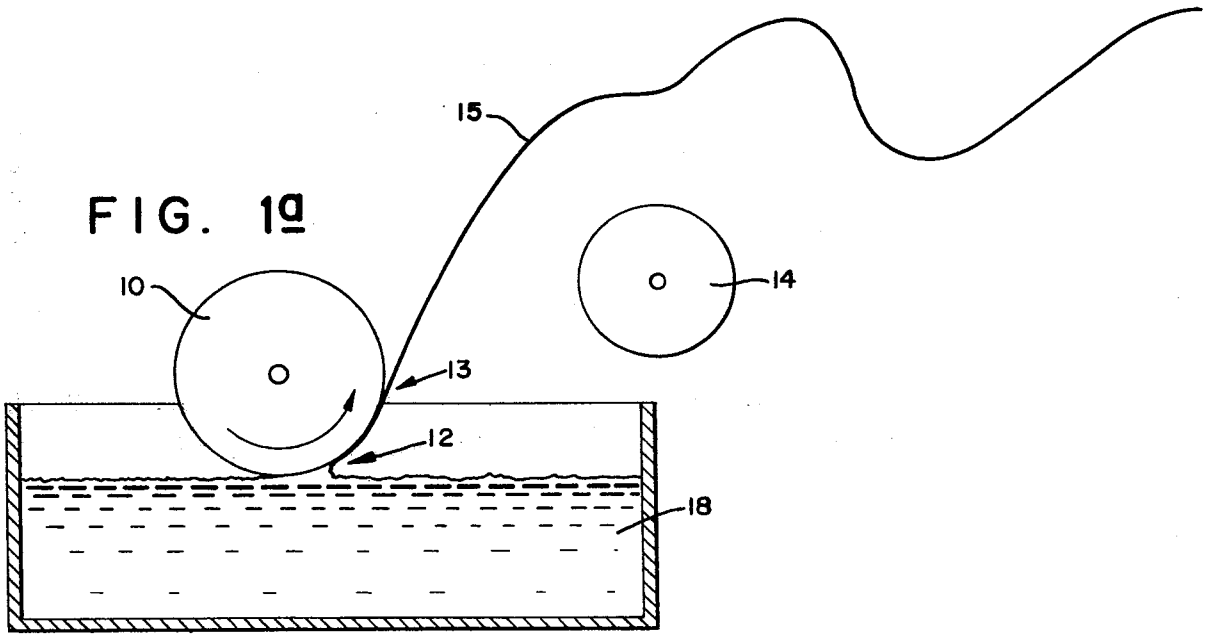
FIG. 1*a* illustrates the relationship of the melt extraction wheel, nip roller and filament during start-up.

During start-up of the process, the nipping roller 14, as shown in FIG. 1*a* is swivelled to a remote position. Rotation of the quenching wheel 10 is initiated and the level of liquid metal 18 in the reservoir 11 is raised by opening a valve from a supplemental reservoir (not shown). When the liquid metal 18 contacts the quench wheel 10, at the contact point 12, formation of the metal filament commences. The filament is flung away by centrifugal action at the point 13 and the nipping roller 14 is then converged toward quenching wheel 10 so that the filament 15 is held between these rotating elements and the filament is conveyed via a tension control regulator 16 to a winder.

The pressure exerted by the nipping roller 14 on the filament 15 isolates the fragile solidification zone 12 to 13 from the tension of the winding arrangement and prevents filament breakage from this source and/or from "whipping" of the filament as it is drawn by the winder. The metal filament 15 is then continuously wound up in packages whose lengths are determined only by the capacity of the winder. Molten metal is admitted to the reservoir 11 to maintain the continuous filament forming process.

Moderate changes in the rotational speed of the quench roller 10 or changes in the thickness of the filament do not substantially affect the winding process or continuity of the filament. As noted hereinabove, an air cylinder or other suitable positioning and/or pressure applying device may be used to hold the nip roller against the quench roller thereby permitting the filament thickness to vary without reduction of nipping pressure.

In FIG. 2, an alternate apparatus is employed to provide a similar result. In FIG. 2, the melt 28 is contained in an insulated container 29 provided with heating element 31. During start-up of the process, the nipping roller 24 is swiveled to a remote position in a manner as described in connection with FIG. 1*a*. Rotation of the quenching wheel 21 is initiated and inert gas 34 is admitted to the melting container or vessel 29. A molten jet 32 is extruded from a suitable opening 33 in the bottom of the container 29 and impinges upon the rotating quench wheel 21 to form a filament 30. The filament has a tendency to be flung away by centrifugal action at that point 23. The nipping roller 24 is converged on wheel 21 and the solidified filament 25 is conveyed to a tension controlled windbar 26 to a storage roller 27 as previously described in connection with FIG. 1.

The nipping rollers 14 and 24 are preferably freely rotating, lightweight devices supported by roller bearings. They may comprise a solid cylinder, a hollow cylinder, or a composite cylinder. A desirable configuration has been found to be a composite hollow cylinder having an outer shell consisting of a material of a high coefficient of friction bonded to an inner annular tube of high strength. The high coefficient of friction of the outer material permits the use of lower nipping pressures as expressed by equation (1). The use of an annular core of high strength permits construction of a nip roller of low movement of inertia. The outer material must also be resistant to the temperatures of the solidified filament at the point of contact.

Included among the materials suitable for use in the outer shell of the nipping wheel used in the practice of the present invention are any materials which are wear resistant under the temperatures of use. Illustrative examples include organic impregnated woven asbestos-brass wire compositions manufactured by Raybestos-Manhattan Corporation and designated as US98 and US2010. The inner core may be steel or similar high strength material.

The wind-up mechanism may be used alone or in conjunction with a separate tension regulating device as 16 and 26. If the wind-up mechanism is used alone, it should contain a means of regulating tension as for example by means of a slip clutch on the winding drum. Alternatively, separate tension regulating devices may be employed; illustrative devices could be counterbalanced, spring-loaded or balanced by means of an air cylinder.

The invention will be further described in the following illustrative examples:

EXAMPLE 1

A grey iron alloy containing 3.4 weight percent carbon, 2.2 weight percent silicon, 0.6 weight percent manganese, 0.2 weight percent phosphorus and 0.01 percent sulfur was melted at 1200°C. in a conventional apparatus for melt extraction similar to that depicted schematically in FIG. 1. However, a nip roller similar to roller 14 was not utilized.

The quenching wheel was constructed of oxygen free high conductivity copper of 8 inch outside diameter and provided with internal channels for the circulation of cooling water. Cooling water was admitted through a rotary union on one side of the hollow quenching wheel shaft and was withdrawn through a rotary union on the opposite side. The face width of the quenching wheel was one inch.

Rotation of the quenching wheel was commenced at 1800 revolutions per minute. The level of the grey iron melt in the crucible was raised by opening a valve to the connecting reservoir. The liquid metal surface was brought into "kissing" contact with the rotating quench wheel. A solidified filament of 1 inch width and 0.0001–0.008 inch thickness was formed on the face of the quench wheel and was flung away by centrifugal action. The arcuate path of the solidified filament commenced at a tangent to the surface of the quenching roll, traveled upward at an angle of 30°–60° to the horizontal, reached a point of maximum elevation and finally turned downward and fell into a catch basin on the floor. The path of the filament was severely affected by "whipping" oscillations induced by random changes in the point and angle of departure of the filament from the quench roll. The filament remained continuous for periods of several seconds until at irregular intervals the oscillations caused the filament to break off near the quench roll.

The filament was seized near the point of departure from the quench roll and guided to engage the winder. At filament tensions of 1–100 grams filament oscillations persisted causing eventual breakage. During the periods between breaks, only relatively unsatisfactorily loosely wound filament was produced. With higher winding tension the filament ruptured in the solidification zone immediately as it was connected to the winder.

EXAMPLE 2

The apparatus of Example 1 was modified by utilizing a nipping roller 14 as depicted in FIG. 1. The nipping roller was of 4 inch overall diameter and consisted of a 4 inch diameter hollow steel cylinder of one-quarter inch wall thickness. In addition, the nip roller was of 2 inch face width and was supported by a one-half inch steel shaft mounted on roller bearings. It was freely rotatable.

The melt extraction process was started with grey iron alloy as described in Example 1. The nip roller 14 was swiveled to the remote position depicted in FIG. 1*a*, the path of the centrifugally flung filament passed above and between the quench roll and the nip roll. The nip roller was then actuated to the "closed" or converged position by means of an air cylinder which pressed the filament against the quenching wheel with a force of 30 pounds. This pressure was chosen by reference to equation (1) as will be explained below. The filament was seized as it passed through the nip zone and guided to engage the winder. The filament was then continuously wound without interruption at 10 pounds tension. Tight, uniform packages of grey iron ribbon 1 inch wide by 0.008 inch thickness were produced for 8 hours without experiencing a break.

The coefficients of dynamic friction for several metal systems are given by The Handbook of Chemistry and Physics, 51st Edition, pp. F15–F17. The coefficient of friction between grey iron and steel is 0.4. The coefficient of friction between steel and a copper film (8 kg. load) is given as 0.2. Taking the latter to be the same as the friction coefficient between grey iron and copper, the necessary minimum nip roll pressure was obtained from equation (1) by making the following substitutions.

$$T = 10 \text{ lbs/in}$$
$$\mu QR = 0.2$$
$$\mu NR = 0.4$$

from equation (1)

$$P \geq \frac{10}{0.2 + 0.4}$$

$$P \geq 16.67 \text{ lbs/in}$$

To provide a margin of safety, the nip roll pressure was set at 30 pounds.

EXAMPLE 3

An alloy formulated to be amorphous upon quenching was charged in an apparatus for chill block spinning similar to that depicted schematically in FIG. 2. However, no nip roller was provided. The quenching wheel was an annular cylinder 16 inch O.D. × 15 inch I.D. × 2 inch face width construction of oxygen free high conductivity copper. Steel end plates and a center supporting shaft were attached to the copper cylinder. The supporting shaft was of 1½ inch O.D. and ½ inch I.D. Its interior communicates with the interior of the quenching wheel. Cooling water was circulated through the steel shaft and the interior of the quenching wheel.

The alloy to be spun consisted of 38 atomic percent iron, 39 atomic percent nickel, 14 atomic percent phosphorus, 6 atomic percent boron and 3 atomic percent aluminum. It was melted in an argon atmosphere at 1000°C. The quench wheel was set into motion at 1800 rpm and the molten alloy extruded through an orifice of 0.010 inch diameter at 300 cm/sec. The molten jet traversed a one inch air gap and impinged upon the surface of the rotating quench wheel. A solidified filament 0.025 inch wide by 0.002 inch thick was formed and was flung away by centrifugal action. The path of the solidifed filament commenced at a tangent to the surface of the quench wheel, traveled downward at an angle of 30°–60° to the horizontal and terminated on the laboratory floor.

The filament was seized near the point of departure from the quench roll and guided to engage the winder. Attempts were made without substantial success to wind the filament continuously under controlled tension. At filament tensions of 1–10 grams filament oscillations persisted causing eventual breakage. During the periods between breaks, only an unsatisfactorily loose filament winding was produced. With higher winding tensions the filament was torn apart in the solidification zone immediately as it was connected to the winder.

EXAMPLE 4

The apparatus of Example 3 was modified by provision of a nipping roller depicted as 24 in FIG. 2. The nipping roller 24 was of 4 inch overall diameter and consisted of a 4 inch diameter hollow steel cylinder of one-quarter inch wall thickness. Roller 24 comprised a 2 inch face width and was supported by a one-half inch steel shaft mounted on roller bearings. The nip roller was freely rotatable.

The chill block spinning process was started using the alloy described in Example 3. The nip roller 24 was swiveled to a position removed from chill roll 21 until the path of the centrifugally flung filament passed above and between the quench roll 21 and the nip roll 24. The nip roller was then actuated to the "closed" or converged position as shown in FIG. 2, by means of an air cylinder (not shown) which pressed the filament against the quenching wheel with a force of 5 pounds. This pressure was chosen by reference to equation (1) as explained below. The filament was seized as it passed through the nip zone and guided to engage the winder. The filament was then continuously wound without interruption at 1 pound tension. Tight uniform packages of metal ribbon 0.025 inch wide by 0.002 inch thickness were produced for 8 hours without experiencing a break.

The coefficients of dynamic friction for several metal systems are given by The Handbook of Chemistry and Physics, 51st Edition, pp F15–F17. The coefficient of friction between cast iron and steel is 0.4. The coefficient of friction between steel and a copper film (8 kg load) is given as 0.2. Taking these to be the same as the friction coefficient between the alloy spun here and the necessary steel and copper, minimum nip roll pressure was obtained from equation (1) by making the following substitutions.

$T = 1.0$ lbs/in.
$\mu QR = 0.2$
$\mu NR = 0.4$ from equation (1)

$$P \geq \frac{1.0}{0.2 + 0.4}$$

$$P \geq 1.67 \text{ lbs/in.}$$

To provide a margin of safety, the nip roll pressure was set at 5 pounds.

I claim:

1. In an apparatus for the production of a solid metal filament from a molten source using a quenching wheel as a quenching element, the improvement which comprises a pressure exerting means for pressing the metal filament against the quenching wheel at a point just beyond the point of solidification of the filament on the quenching wheel, thereby creating a tension-free zone and inhibiting premature detachment of the filament from the quenching wheel.

2. The apparatus of claim 1 wherein the pressure exerting means is a cold nipping wheel.

3. The apparatus of claim 2 wherein the nipping wheel rotates on an axis substantially parallel to the axis of the quenching wheel.

4. The apparatus of claim 1 which includes a tension regulating collecting device.

* * * * *